US005215078A

United States Patent [19]

Fulop

[11] Patent Number: 5,215,078

[45] Date of Patent: Jun. 1, 1993

[54] RECIPROCATING DOUBLE APPLICATOR MASSAGER

[76] Inventor: Charles Fulop, 17664 Candlewood Ter., Boca Raton, Fla. 33487

[21] Appl. No.: 844,292

[22] Filed: Mar. 2, 1992

[51] Int. Cl.[5] ..... A61H 7/00; A61H 15/00

[52] U.S. Cl. ..... 128/52; 128/57

[58] Field of Search ..... 128/25 R, 26, 32, 36, 128/42, 44, 51, 52, 57, 53, 59–62 R

[56] References Cited

U.S. PATENT DOCUMENTS

| | | | |
|---|---|---|---|
| 2,181,282 | 11/1939 | Oster | 128/36 |
| 2,461,102 | 2/1949 | Ackerman | 128/52 X |
| 3,638,939 | 2/1972 | Langley | 128/25 R X |
| 3,799,155 | 3/1974 | Gerlich | 128/52 X |
| 3,996,929 | 12/1976 | Mabuchi | 128/52 X |
| 4,041,938 | 8/1977 | Wintoniw | 128/52 |
| 4,291,686 | 9/1981 | Miyashiro | 128/52 |
| 4,506,659 | 3/1985 | Chester | 128/52 |
| 4,729,368 | 3/1988 | Guitay | 128/57 |
| 4,744,350 | 5/1988 | Sato | 128/57 |
| 5,097,822 | 3/1992 | Francis et al. | 128/52 |

*Primary Examiner*—Robert A. Hafer
*Assistant Examiner*—Brian E. Hanlon
*Attorney, Agent, or Firm*—Alvin S. Blum

[57] ABSTRACT

A massager includes an electric motor driven eccentric cam (7) in a housing (1). A moving member (8) is slidably mounted on the housing and is driven by the eccentric cam in a reciprocating, translatory motion relative to the housing. A hand grip (18) is mounted on each of the opposed ends of the moving member. The massager is held in the two hands by the hand grips. The housing reciprocates in translatory motion relative to the hand grips and imparts inertial forces to the grips and the hands for massaging action on both the hands and arms simultaneously. The massager is more easily held by arthritic hands than conventional devices. The device may be held between other paired body parts such as ankles and knees for applying massage therapy thereto. An alternative embodiment includes a series of parallel rollers pivotally attached to the housing for application to a body part such as the scalp when held by the two hand grips.

8 Claims, 1 Drawing Sheet

FIG. 3
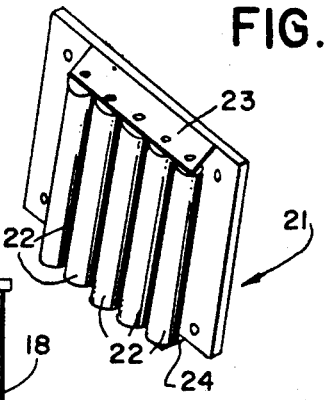
FIG. 2
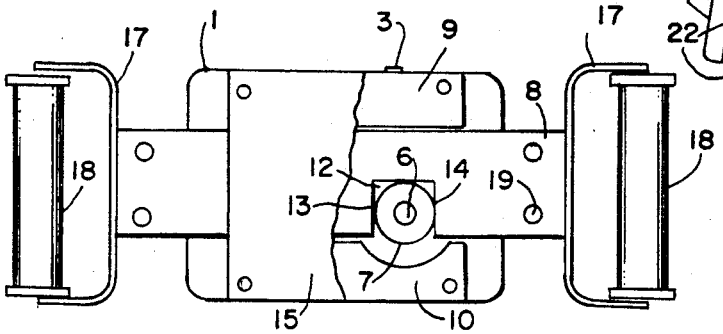
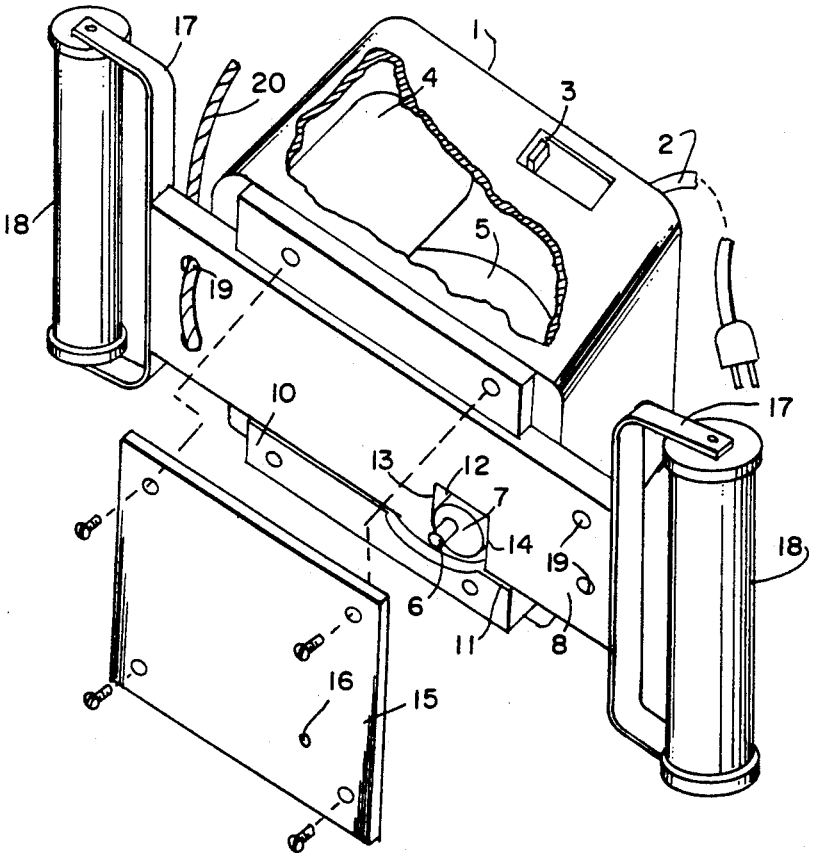
FIG. 1

RECIPROCATING DOUBLE APPLICATOR MASSAGER

BACKGROUND OF THE INVENTION

This invention relates to electro-mechanical massaging devices and more particularly to a massager having a pair of opposed applicators that are driven in a reciprocating motion by an electric motor.

Electrically driven vibrators and massagers are well known in the art. Those that are hand-held generally hold the motor portion immobile while a driven applicator portion moves through a prescribed motion. The applicator is applied to a body part to apply the motion to the body part.

Many of the ailments that are amenable to massage therapy such as arthritis occur in paired body parts, i.e. the limbs, and especially the joints in hands, wrists, elbows, shoulders, feet, ankles, knees and hips. It is often awkward to treat the paired joints with conventional massagers, where the applicator must first be held against one joint of the pair and then against the second joint of the pair. The problem is further compounded by arthritis in the hands or arms that may make the holding of a conventional massager awkward or painful.

SUMMARY OF THE INVENTION

It is accordingly an object of the invention to provide a massager that is applicable to two opposed limb joints simultaneously. It is another object of the invention to provide a massager that is more easily held and applied by an individual with impaired hand operating function.

The massager of the invention comprises an electric motor in a housing that drives a rotary eccentric cam. A moving member, having a fixed length, is slidably mounted in the housing, and is driven through a reciprocating, translatory motion by the electric cam. Attached to opposite ends of the moving member are hand grips, arranged so that one hand may grip each hand grip to support the entire massager between the hands. When so held, the housing is moved back and forth in the reciprocating motion and tends to impart those forces to the handles and the hands. Most of the mass is within the housing, and its inertia creates periodic forces on the two hands that have been found to provide a very beneficial effect on arthritic hands and arms. The deice may be held between the feet, knees, elbows as well to massage those areas. Optionally attached to the housing are a set of rollers, whereby the rollers may be applied to a body part, such as the scalp, while the moving member is hand held by the two handles.

These and other objects, advantages and features of the invention will become more apparent when the detailed description is studied in conjunction with the drawings, in which:

BRIEF DESCRIPTION OF THE DRAWINGS

FIG. 1 is a perspective view of the massager of the invention with cover plate removed.

FIG. 2 is a plan view of the massager with cover plate partially broken away.

FIG. 3 is a perspective view of an alternative cover plate for the massage with roller applicator.

DETAILED DESCRIPTION OF PREFERRED EMBODIMENTS

Referring now first to FIGS. 1 and 2, the massager comprises a housing 1 enclosing an electric motor 4, with power cord 2 and on/off, speed control 3. The motor 4 drives a reduction gear assembly 5 that rotates shaft 6. An eccentric cam is affixed to shaft 6. Two elongate bosses 9 and 10 provide a slide channel 11 in which is slidably mounted moving member 8 for reciprocating, translatory motion within the slide channel 11. A rectangular aperture 12 in the moving member 8 is engaged by the rotting eccentric cam 7 alternately pressing against side 13 and then side 14 of the aperture 12 in the moving members 8 to impart reciprocating translatory motion to the moving member 8 relative to the housing 1. Cover 15 closes the open face of the channel 11 to form thereby an enclosed channel open on two opposed ends. A bearing 16 is provided in the cover to support the free end of shaft 6. The moving member 8 is provided at each free end with a handle support 17 that supports an elongate hand grip 18 so that a hand may comfortably encircle each hand grip to support the massager with minimal effort by both hands.

To operate the device, one hand holds each hand grip 18 and the cam action forces the housing back and forth in a reciprocating motion that applies the kinetic energy for the moving housing to each grip alternately. This stimulates the circulation in the hands and arms. To massage the feet, ankles or knees, the hands holding the massager may be gripped between the knees, etc. to transfer the massaging forces to the other body parts.

Alternatively, the hand grips 18 may be held directly between the knees for example. The vibrations imparted to the body parts stimulate the circulation to those parts and tend to relieve pain and discomfort from a variety of ailments including arthritis. Moles 19 may be provided in the moving member 8 to permit the attachment of a rope 20 so that the massager may be hung around the neck. This provides for massaging the neck to relieve neck discomfort and certain tension headaches.

FIG. 3 shows an alternative cover 21 for the housing that includes elongate rollers 22 that are rotatably mounted at both ends in pivot mountings 23 and 24. When the massager is held by the handles and the rollers are applied to the skin or scalp, for example, an invigorating and circulation-stimulating massage is applied even by those with disabled hands.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A massage device comprising:

A) a moving member having a fixed length;

B) an eccentric cam means operatively connected to said moving member for driving said moving member in a reciprocating, translatory motion;

C) an electric motor means operatively connected to said cam means for rotating said cam means;

D) a housing enclosing said motor means;

E) mounting means on said housing for slidably mounting said moving member thereon to enable said moving member to move reciprocatingly relative to said housing when driven by said cam means during rotation of said cam means;

F) said moving member having two opposed, short ends, with each said short end attached to a hand grip means for grasping with a hand, said hand grip means being spaced apart by a fixed distance, said housing being located between said hand grip means and entirely supported thereby, and said translatory motion being parallel to a line connecting said hand grip means, whereby said hand grip means and said moving member are arranged to move in concert relative to said housing.

2. The massage device according to claim 1, in which said moving member is provided with a rectangular aperture means for engaging said cam means.

3. The massage device according to claim 1, in which a plurality of elongate rollers are pivotally mounted on said housing in parallel array.

4. A massage device comprising:

A) a moving member having a fixed length;

B) an eccentric cam means operatively connected to said moving member for driving said moving member in a reciprocating, translatory motion;

C) an electric motor means operatively connected to said cam means for rotating said cam means;

D) a housing enclosing said motor means;

E) mounting means on said housing for slidably mounting said moving member thereon to enable said moving member and said housing to move reciprocatingly with respect to one another when said moving member is driven by said cam means during rotation of said cam means;

F) said moving member having two opposed, short ends, with each said short end attached to a hand grip means for directly applying reciprocating motion to a separate body part, said applicator means being spaced apart by a fixed distance, said housing being located between said applicator means and entirely supported thereby, and said translatory motion being parallel to a line connecting said applicator means, whereby reciprocating massaging forces are transmitted to both said applicator means simultaneously and said applicator means and said moving member move together relative to said housing.

5. The massage device according to claim 4, in which said moving member is provided with a rectangular aperture means for engaging said cam means.

6. The massage device according to claim 4, in which a plurality of elongate rollers are pivotally mounted on said housing in parallel array.

7. The massage device according to claim 4, in which both of the applicator means are driven in the same direction at the same time.

8. The massage device according to claim 7, in which said applicator means are constructed for grasping by the hands of a user.

* * * * *